US008774671B2

(12) United States Patent
Okabe

(10) Patent No.: US 8,774,671 B2
(45) Date of Patent: Jul. 8, 2014

(54) DEVELOPING CARTRIDGE CAPABLE OF PROVIDING STABILIZED ELECTRICAL POWER SUPPLY TO DEVELOPING ROLLER

(75) Inventor: Yasushi Okabe, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 154 days.

(21) Appl. No.: 13/351,325

(22) Filed: Jan. 17, 2012

(65) Prior Publication Data

US 2012/0195621 A1 Aug. 2, 2012

(30) Foreign Application Priority Data

Jan. 28, 2011 (JP) ..... 2011-016861

(51) Int. Cl.
*G03G 15/00* (2006.01)
*G03G 15/08* (2006.01)
*G03G 21/16* (2006.01)

(52) U.S. Cl.
CPC ..... *G03G 21/1652* (2013.01); *G03G 15/0834* (2013.01); *G03G 2215/0141* (2013.01); *G03G 21/1676* (2013.01)
USPC ..... 399/90; 399/113; 399/109; 399/119

(58) Field of Classification Search
USPC ..... 399/90, 113, 109, 111, 112, 267, 274, 399/284
See application file for complete search history.

(56) References Cited

U.S. PATENT DOCUMENTS

2001/0041079 A1* 11/2001 Michlin et al. ..... 399/90

FOREIGN PATENT DOCUMENTS

JP 08-314358 11/1996
JP 2010-197777 9/2010

* cited by examiner

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

A developing cartridge having a collar member provided over an axially end portion of a developing roller shaft and movable in an axial direction thereof. The collar member includes a cap portion covering the axial end portion of the rotation shaft and electrically contacted with the rotation shaft, and a power-feed receiving portion electrically connected to the cap portion and electrically contactable with an external electrode. The power-feed receiving portion is provided integrally with the cap portion.

19 Claims, 5 Drawing Sheets

TOP
LEFT
RIGHT
BOTTOM
31
14
15
30
29
29B(29)
29A(29)
34
40
27
57
38
32
62
53
51
33
52
54
61

DEVELOPING CARTRIDGE CAPABLE OF PROVIDING STABILIZED ELECTRICAL POWER SUPPLY TO DEVELOPING ROLLER

CROSS REFERENCE TO RELATED APPLICATION

This application claims priority from Japanese Patent Application No. 2011-016861 filed Jan. 28, 2011. The entire content of the priority application is incorporated herein by reference.

TECHNICAL FIELD

The present invention relates to a developing cartridge provided in an electro-photographic type printer.

BACKGROUND

A conventional color printer as an electro-photographic type printer includes a photosensitive body configured to carry a toner image, and a developing cartridge provided with a developing roller as a developer carrier configured to supply toner to the photosensitive body.

Japanese Patent Application Publication 2010-197777 discloses such a conventional developing cartridge including a metallic electrode plate to which an electric power is supplied from an external power source in a casing of the printer, and an electrically conductive bearing member electrically connected to the electrode plate and rotatably supporting a shaft of the developing roller.

SUMMARY

With this configuration, because the electric power is supplied from the external power source to the shaft of the developing roller by way of the electrode plate and the bearing member. Therefore, there are three electrical contacts first one is between the external power source and the electrode plate, second one is between the electrode plate and the bearing member, and third one is between the bearing member and the shaft of the developing roller. In this case, electrical contact form the external power source to the shaft of the developing roller may be unstable.

It is therefore, an object of the present invention to provide a developing cartridge capable of providing a stabilized electrical power supply to the developer carrier.

In order to attain above and other objects, the present invention provides a developing cartridge. The developing cartridge is detachable from and attachable to a main casing of an image forming device. The image forming device has an external electrode to which an electrical power is supplied. The developing cartridge includes a cartridge frame, a developer carrier, a bearing member, and a collar member. The developer carrier has a surface that carries a developer agent and a rotation shaft made from an electrically conductive material. The rotation shaft defines an axial direction and has an axial end portion. The bearing member is provided at the cartridge frame and rotatably supporting the rotation shaft. The collar member is provided at a position outside of the bearing member in the axial direction and movable relative to the bearing member in the axial direction. The collar member includes a cap portion and a power-feed receiving portion. The cap portion covers the axial end portion of the rotation shaft and is electrically contacted with the rotation shaft. The cap portion is made from an electrically conductive material. The power-feed receiving portion is made from an electrically conductive material and electrically contactable with the external electrode. The power-feed receiving portion is provided integrally with the cap portion.

BRIEF DESCRIPTION OF THE DRAWINGS

The particular features and advantages of the invention as well as other objects will become apparent from the following description taken in connection with the accompanying drawings, in which:

FIG. 4(*b*) is an enlarged view showing an essential portion of FIG. 4(*a*) and FIG. 5 is a view for description of an electrical power supply to the developing roller.

DETAILED DESCRIPTION

Figure 1:
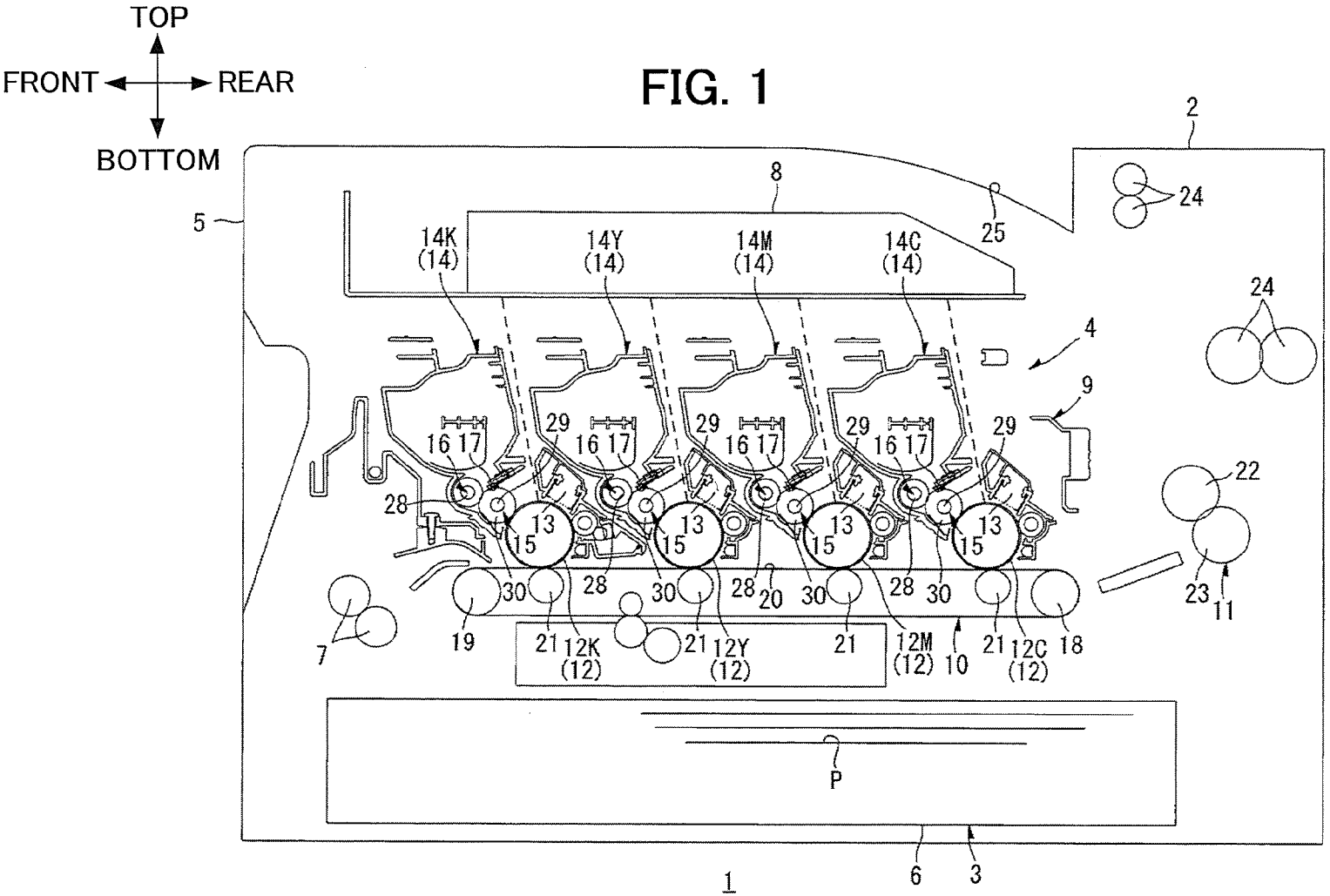
FIG. 1 is a schematic cross-sectional view of a color printer in which a toner cartridge according to one embodiment of the present invention is provided.

A developing cartridge according to one embodiment of the present invention will be described while referring to the accompanying drawings. FIG. 1 shows a color printer 1 in which the developing cartridge is provided.

1. Structure of Color Printer

As shown in FIG. 1, the color printer is a horizontal direct tandem-type color laser printer 1. The color laser printer 1 includes a main casing 2. Within the main casing 2, a sheet supply unit 3 for supplying a sheet P and an image forming unit 4 for forming an image on the sheet P supplied from the sheet supply unit 3 are provided.

(1) Main Casing

The main casing 2 is formed in a rectangular box shape in which the sheet supply unit 3 and the image forming unit 4 are accommodated. The main casing 2 has a front portion at which a front cover 5 is provided. The front cover 5 is pivotally movable about its lower end relative to the main casing 2 to open and close a front opening formed in the front portion of the main casing 2. A stationary electrode 84 (FIG. 5) is provided in the main casing 2. The stationary electrode 84 is electrically connected to a power source 85 provided in the main casing 2. A process unit 9 (described later) is movable through the opening and is accessible to a user by opening the front cover 5.

The terms "upward", "downward", "upper", "lower", "above", "below", "right", "left", "front", "rear" and the like will be used throughout the description assuming that the color laser printer 1 is disposed in an orientation in which it is intended to be used. In the following description, a side of the color laser printer 1 on which the front cover 5 is provided (left side in FIG. 1) will be referred to as a front side of the color laser printer 1. Left and right sides of the color laser printer 1 in the following description will be based on the reference point of a user viewing the color laser printer 1 from the front side. More specifically, in FIG. 1, a near side and a far side are a right side and a left side, respectively.

(2) Sheet Supply Unit

The sheet supply unit 3 includes a sheet supply tray 6 which is disposed in a lower section of the main casing 2 for accommodating the sheets P. The color laser printer 1 also includes a pair of registration rollers 7 disposed above a front end portion of the sheet supply tray 6.

Each sheet P accommodated in the sheet supply tray 6 is supplied to a position between the registration rollers 7, and further to the image forming unit 4 (more precisely to a position between a photosensitive drum 12 (described later) and a conveying belt 20 (described later)) at a predetermined timing.

(3) Image Forming Unit

The image forming unit 4 includes a scanner unit 8, the process unit 9, a transfer unit 10, and a fixing unit 11.

(3-1) Scanner Unit

The scanner unit 8 is disposed at an upper section of the main casing 2. Based on image data, the scanner unit 8 irradiates laser beams to expose four photosensitive drums 12 (described later) as indicated by broken lines shown in FIG. 1.

(3-2) Process Unit

The process unit 9 is disposed below the scanner unit 8 and above the transfer unit 10. The process unit 9 includes four photosensitive drums 12 (described later) corresponding to four colors respectively, four Scorotron chargers 13 each corresponding to each photosensitive drum 12, and four developing cartridges each corresponding to each photosensitive drum 12. The process unit 9 is slidably movable in the frontward/rearward direction relative to the main casing 2.

The four photosensitive drums 12 are juxtaposed with each other in the front-to-rear direction at fixed intervals such that each photosensitive drum 12 extends in a right-to-left or lateral direction. More specifically, the photosensitive drums 12 include a black photosensitive drum 12K, a yellow photosensitive drum 12Y, a magenta photosensitive drum 12M, and a cyan photosensitive drum 12C in the order from front to rear.

Each of the chargers 13 is disposed at a position diagonally above and rearward of the corresponding photosensitive drum 12 so as to confront the photosensitive drum 12 with a gap therebetween.

The four developing cartridges 14 have a one-on-one correspondence to the four photosensitive drums 12. Each of the developing cartridges 14 is disposed above the corresponding photosensitive drum 12, and detachably supported to a frame of the process unit 9. More specifically, the developing cartridges 14 include a black developing cartridge 14K, a yellow developing cartridge 14Y, a magenta developing cartridge 14M, and a cyan developing cartridge 14C in the order from front to rear. Each developing cartridge 14 includes a developing roller 15 as a developer carrier.

Figures 4A, 4B:
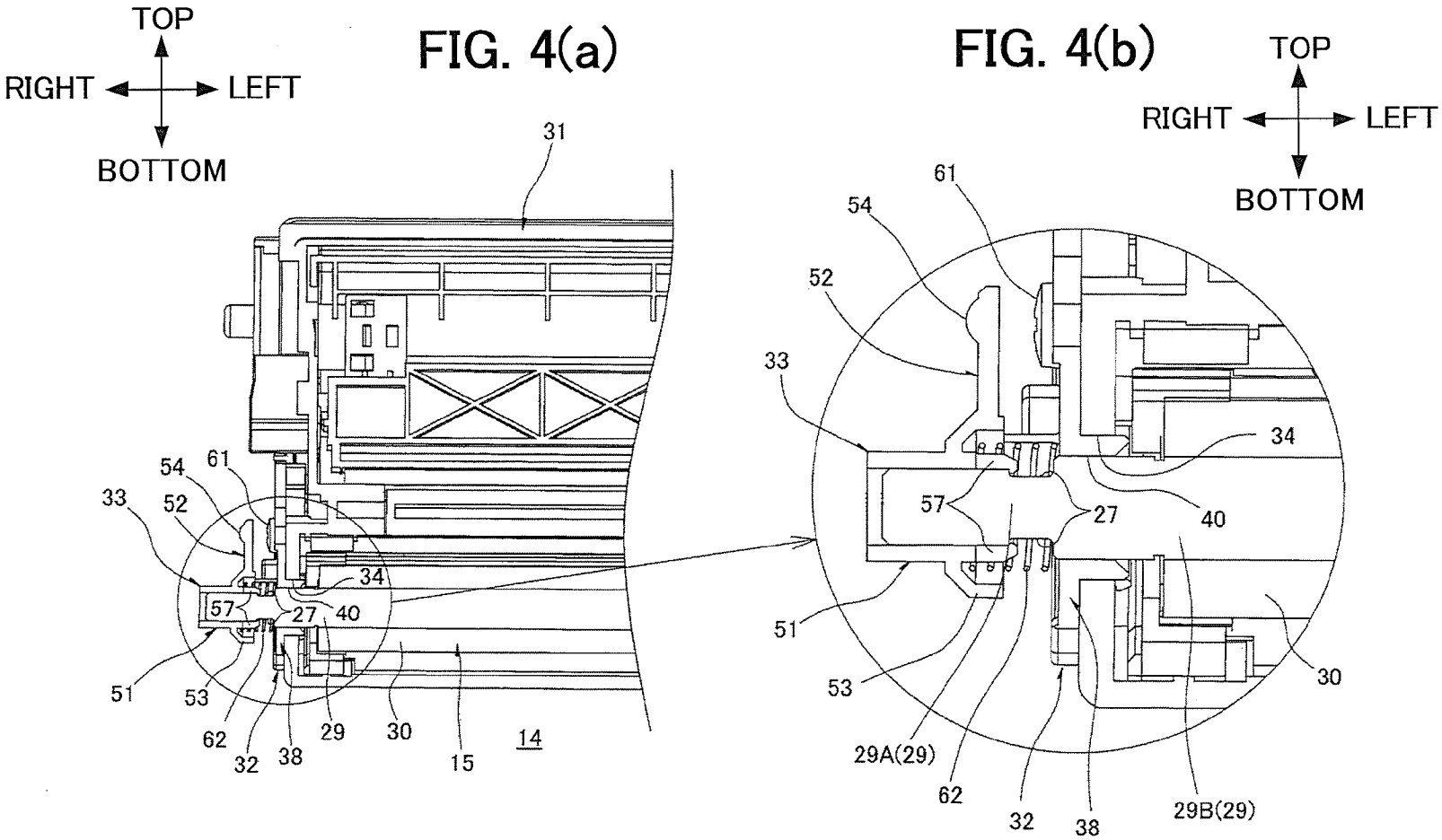
FIG. 4(*a*) is a cross-sectional view taken along the line IV-IV in FIG. 2.

The developing roller 15 is rotatably supported at the bottom of the developing cartridge 14 such that a rear portion of the developing roller 15 is exposed outside the developing cartridge 14 and contacts an upper front portion of the photosensitive drum 12. As shown in FIG. 4, the developing roller 15 includes a roller shaft 29 as a rotation shaft made from metal, and a covering layer 30 made from resin formed over an outer peripheral surface of the roller shaft 29 except each lateral end portion thereof. The developing roller shaft 29 is made from an electrically conductive material.

As shown in FIG. 4(*b*), the developing roller shaft 29 includes a main portion 29B and a protruding portion 29A at a right side of the main portion. The protruding portion 29A has a diameter smaller than that of the main portion 29B. The protruding portion 29A has a left end portion formed with an engagement groove 27 recessed radially inward of the developing roller shaft 29. The engagement groove 27 has a predetermined width in an axial direction of the roller shaft 29.

Each developing cartridge 14 further includes a supply roller 16 for supplying toner to the developing roller 15, and a thickness-regulation blade 17 for regulating a thickness of the toner supplied to the developing roller 15. The developing cartridge 14 accommodates toner of each color in a space defined above the supply roller 16 and the thickness-regulation blade 17.

(3-2-2) Developing Operation in Process Unit

The toner accommodated in the developing cartridge 14 is supplied to the supply roller 16 and further to the developing roller 15, and tribocharged to a positive polarity at a position between the supply roller 16 and the developing roller 15.

The toner supplied to the developing roller 15 is formed into a thin layer having a uniform thickness on a surface of the developing roller 15 (a surface of the covering layer 30) by the thickness-regulation blade 17 as the developing roller 15 rotates.

A surface of the photosensitive drum 12 is uniformly charged to a positive polarity by the Scorotron charger 13 in association with rotation of the photosensitive drum 12. Then, the surface is subjected to high speed scan of the laser beam (indicated by the broken line) emitted from the scanner unit 8. As a result, an electrostatic latent image corresponding to an image to be formed on the sheet P is formed on the surface of the photosensitive drum 12.

When the photosensitive drum 12 further rotates, the toner deposited on the developing roller 15 and charged to a positive polarity is selectively supplied to the electrostatic latent image formed on the surface of the photosensitive drum 12, thereby forming a toner image on the surface of the photosensitive drum 12 by a reverse development.

(3-3) Transfer Unit

The transfer unit 10 is disposed above the sheet supply unit 3 and below the process unit 9 in the main casing 2 along the front-to-rear direction. The transfer unit 10 includes a drive roller 18, a driven roller 19, the conveying belt 20, and four transfer rollers 21.

The drive roller 18 and the driven roller 19 are disposed in confrontation with and spaced apart from each other in the front-to-rear direction. The conveying belt 20 is an endless belt stretched around the drive roller 18 and the driven roller 19 such that a top portion of the conveying belt 20 confronts and contacts the photosensitive drums 12. When the drive roller 18 is driven to rotate, the conveying belt 20 circulates such that the top portion of the conveying belt 20 moves rearward from the front.

Each of the transfer rollers 21 is provided at a position confronting the corresponding photosensitive drum 12, with an upper portion of the conveying belt 20 interposed therebetween.

The sheet P supplied from the sheet supply unit 3 to the image forming unit 4 is conveyed rearward by the conveying belt 20 and passes through transfer positions between the photosensitive drums 12 and the conveying belt 20 sequentially. The toner image of each color carried on the photosensitive drum 12 is transferred onto the sheet P while the sheet P is conveyed by the conveying belt 20, thereby forming a color image on the sheet P.

(3-4) Fixing Unit

The fixing unit 11 is disposed rearward of the transfer unit 10, and includes a heat roller 22 and a pressure roller 23 confronting the heat roller 22. In the fixing unit 11, the color image transferred onto the sheet P is thermally fixed onto the sheet P by heat and pressure while the sheet P passes through a position between the heat roller 22 and the pressure roller 23.

(4) Discharge of Sheet

The sheet P on which the monochromatic or color image has been fixed is conveyed by discharge rollers 24 through a U-shaped path (not shown) and discharged to a discharge tray 25 formed above the scanner unit 8.

2. Detailed Structure of Process Frame (1) Side Plate

Figure 5:
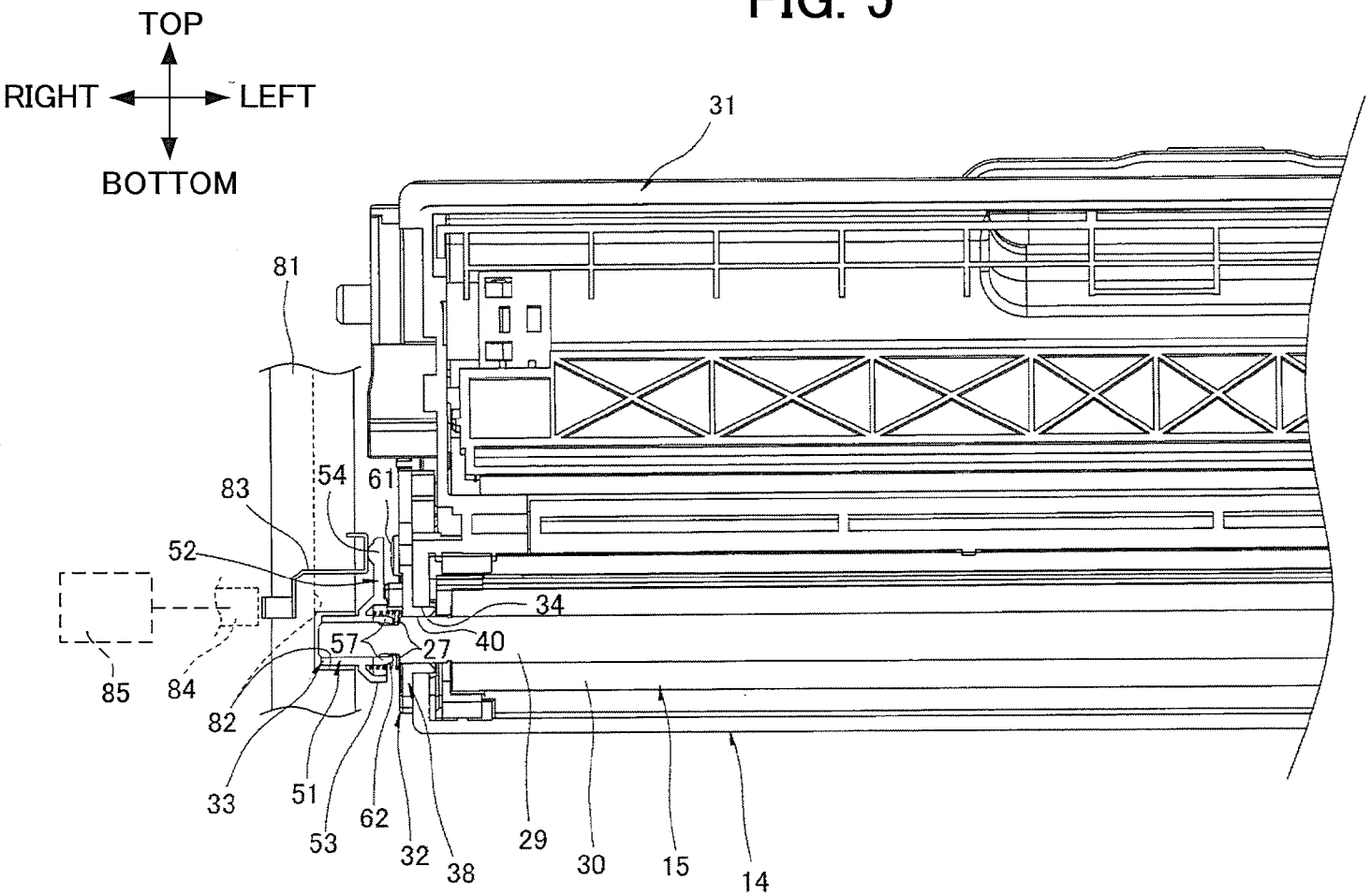

As shown in FIG. 5, the process unit 9 includes a pair of side plates 81 disposed in confrontation with and spaced apart from each other in the right-to-left direction for supporting each lateral end portion of the photosensitive drum 12. Hereinafter, a right side plate 81 will only be described as the side plate 81, since a structure for an electrical supply to the developing roller 15 is only provided at the right side plate 81. Description for a left side plate 81 will be omitted.

The side plate 81 extends in frontward/rearward direction and has a generally flat plate shape. The side plate 81 is formed with a guide groove 82 for guiding detaching and attaching movement of each developing cartridge 14. The side plate 81 has a relay electrode 83 as an external electrode to which an electric power is supplied from the main casing 2.

The guide groove 82 is formed at a laterally inner surface of the side plate 81 and diagonally extends downward and rearward from an upper end of the side plate 81. The guide groove 82 has a width capable of receiving a right end portion of a collar portion 51 (described later) of the developing cartridge 14.

The relay electrode 83 is generally plate shaped and is provided at the side plate 81. The relay electrode 83 extends through a thickness of the side plate 81. The relay electrode 83 bends such that some portions extend in lateral direction and remaining portions extend in vertical direction as shown in FIG. 5. The relay electrode 83 has a left end portion positioned at an upper side of a rear end portion of the guide groove 82 and protruding leftward from a left side surface of the side plate 81, and has a right end portion protruding rightward from a right side surface of the side plate 81.

(2) Developing Cartridge

Figure 2:
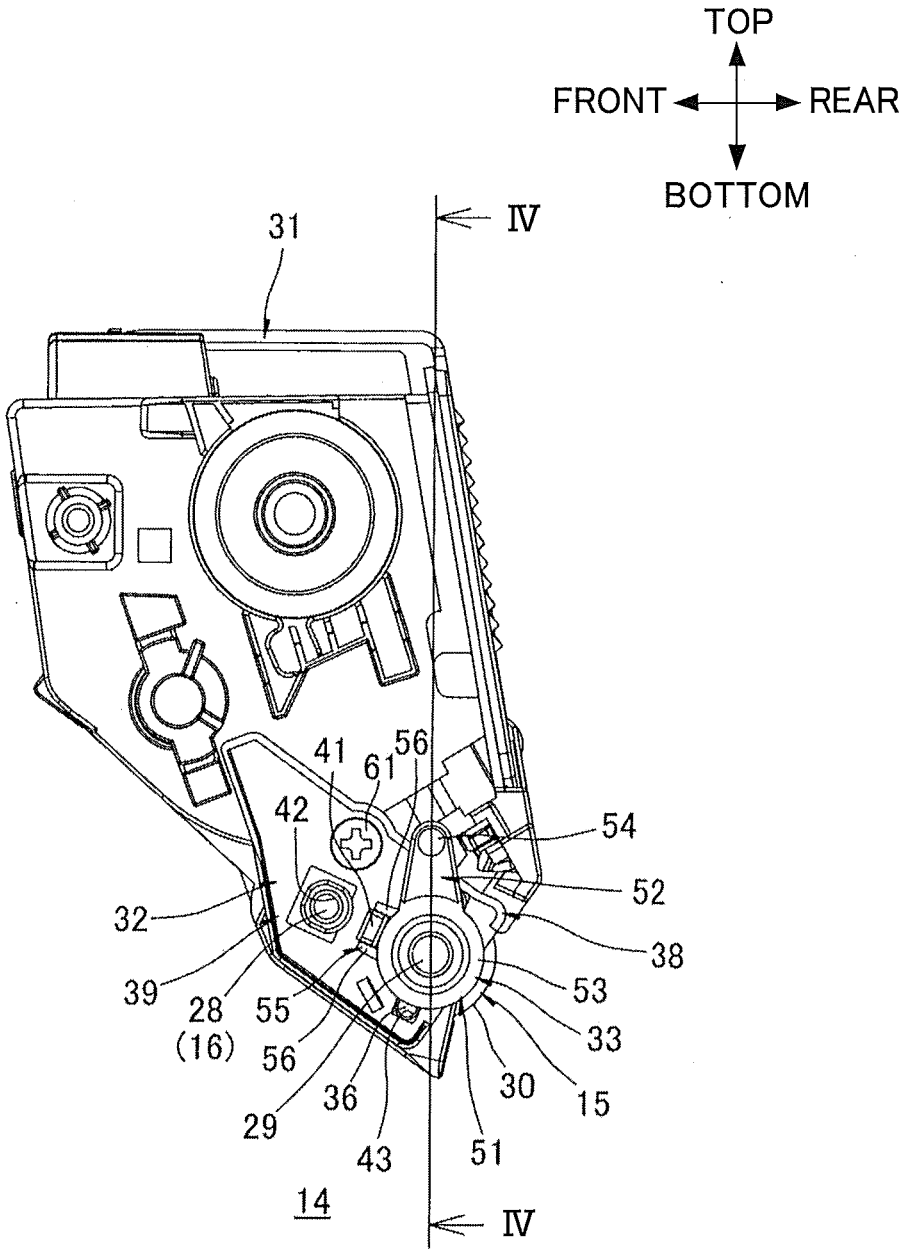
FIG. 2 is a left side view of the developing cartridge according to the embodiment.
Figure 3:
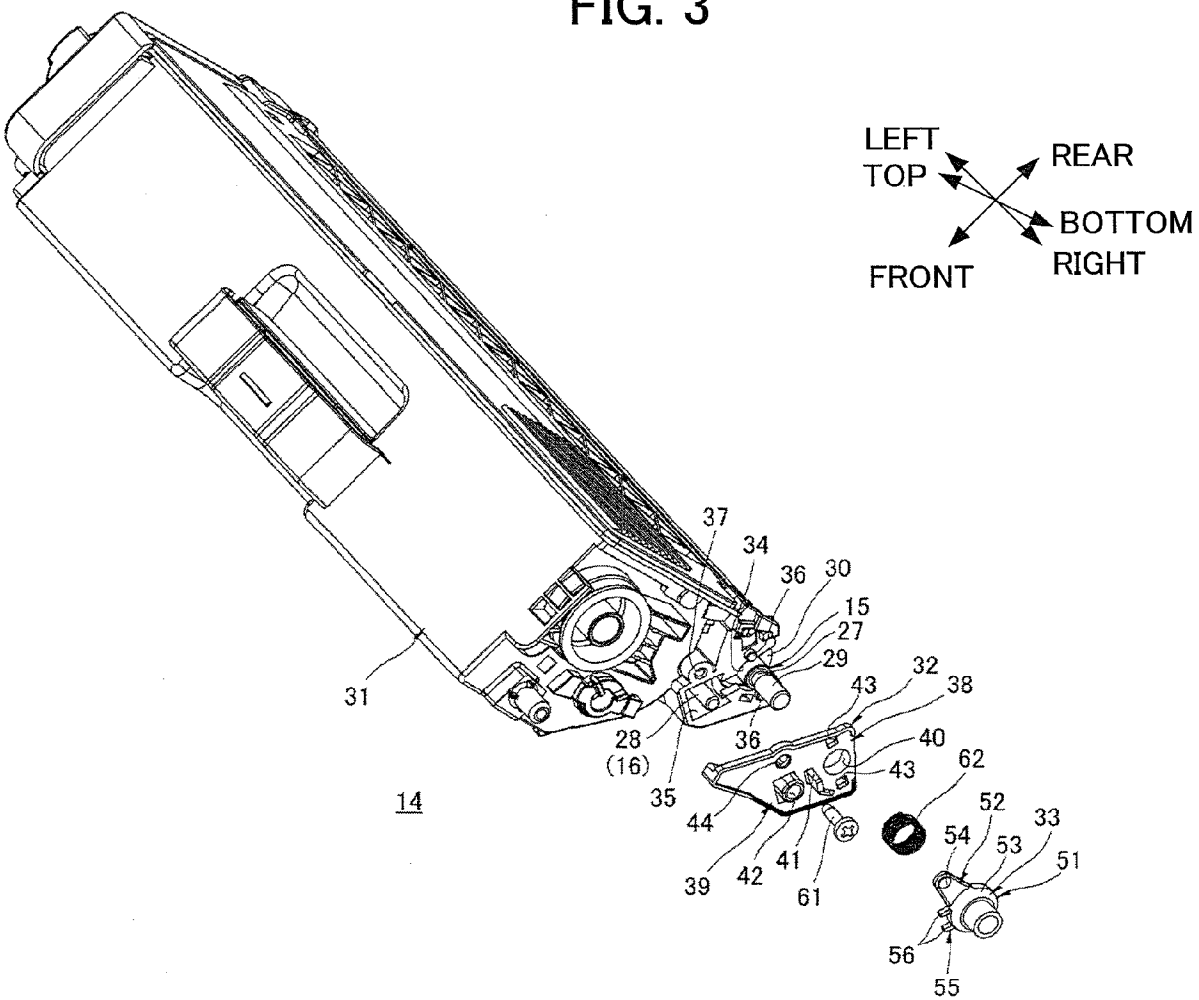
FIG. 3 is an exploded perspective view of the developing cartridge as viewed from an upper right side.

As shown in FIGS. 2 and 3, the developing cartridge 14 includes a cartridge frame 31 as a frame for rotatably supporting the developing roller 15, a bearing member 32 for rotatably supporting a right end portion of the developing roller shaft 29 (i.e., right end portion of the main portion 29B), and a collar member 33 capping on the right end portion of the developing roller shaft 29. The developing roller shaft 29 and the collar member 33 are relatively rotatable.

The cartridge frame 31 is box-shaped and extends in the lateral direction. The cartridge frame 31 has a generally isosceles triangle shape whose apex end is deviated rearward and downward as shown in FIG. 2.

The cartridge frame 31 has a right side wall formed with a notch or a groove 34 through which the right end portion of the developing roller shaft 29 extends, and a hole 35 through which a right end portion of a shaft 28 of the supply roller 16 extends. The notch 34 is positioned at a lower end portion of the cartridge frame 31 and is generally U-shaped recessed frontward from a rear end of the cartridge frame 31. The hole 35 is positioned frontward of the notch 34 and has a rectangular shape in a side view.

The right side wall of the cartridge frame 31 is provided with a pair of bosses 36 for positioning the bearing member 32, and is formed with a thread hole 37 threadingly engageable with a thread 61 for fixing the bearing member 32 to the cartridge frame 31. The pair of bosses 36 is cylindrical shaped and protrudes rightward from the right wall of the cartridge frame 31. The pair of bosses 36 is arrayed in the vertical direction such that the notch 34 is positioned between the pair of bosses 36. The thread hole 37 is positioned above the hole 35.

The bearing member 32 is provided at the right end of the cartridge frame 31, and has a first bearing portion 38 for rotatably supporting the right end portion of the developing roller shaft 29 and a second bearing portion 39 for rotatably supporting the supply roller shaft 28.

The first bearing portion 38 occupies a rear half of the bearing member 32, and is formed with an insertion hole 40 through which the right end portion of the developing roller shaft 29 extends. Further, the first bearing portion 38 is provided with a restricting portion 41 for restricting rotation of the collar member 33.

The insertion hole 40 is penetrated through a thickness of the bearing member 32 and has a generally cylindrical shape whose inner diameter is approximately equal to or slightly greater than an outer diameter of the developing roller shaft 29.

The restricting portion 41 is positioned frontward of the insertion hole 40 and rearward of an insertion hole 42 (described later) of the second bearing portion 39. The restricting portion 41 protrudes rightward from a right side surface of the bearing member 32, and has a generally rectangular column shape.

The second bearing portion 39 occupies a front half of the bearing member 32, and is formed with the insertion hole 42 through which the right end portion of the supply roller shaft 28 extends. The insertion hole 42 is positioned spaced away from and frontward of the insertion hole 40, and has an inner diameter approximately equal to or slightly greater than an outer diameter of the supply roller shaft 28.

The bearing member 32 is formed with a pair of positioning holes 43 and a thread insertion hole 44. The pair of positioning holes 43 is arrayed in the vertical direction such that the insertion hole 40 is positioned between the pair of positioning holes 43. The pair of positioning holes 43 is adapted to receive therein the pair of bosses 36 of the cartridge frame 31, and has a rectangular shape in a side view and extends through a thickness of the bearing member 32. The thread insertion hole 44 is positioned above the insertion hole 42 and has a generally cylindrical shape in the side view for inserting therein the thread 61.

The collar member 33 is positioned at right side of the first bearing portion 38 of the bearing member 32. The collar member 33 is made from an electro-conductive resin and includes the collar portion 51 and an extension portion 52 integrally therewith and extending upward from the collar portion 51. The collar portion 51 functions as a cap portion capped on the right end portion of the developing roller shaft 29. The developing roller shaft 29 is rotatable relative to the collar portion 51.

The collar portion 51 extends in the lateral direction and has a hollow cylindrical shape whose inner diameter is approximately equal to or slightly greater than the outer diameter of the developing roller shaft 29. The collar portion 51 has a left end portion provided with a circular flange portion 53. The collar portion 51 includes a pair of engagement pawls 57 engageable with the engagement groove 27 of the developing roller shaft 29, and a fitting portion 55 loosely fitted with the restricting portion 41 of the bearing member 32.

The pair of engagement pawls 57 is hook shaped and provided at a left end of the collar portion 51 at diametrically opposite sides thereof as shown in FIG. 4(*b*). Each left end portion of each engagement pawl 57 is bent radially inwardly to be engaged with the engagement groove 27. Here, the radially inwardly projecting length of end of each pawl 57 is configured so as not to reach a bottom of the engagement groove 27.

The fitting portion 55 is defined by an outer peripheral surface of the flange portion 53 and a pair of bosses 56 protruding frontward from the outer peripheral surface of the flange portion 53, so that the fitting portion 55 is generally U-shaped in the side view as best shown in FIG. 3. The pair of bosses 56 is spaced away from each other such that a distance between the bosses 56 and 56 is greater than the vertical length of the restricting portion 41. Thus, the fitting portion 55 can receive therein the restricting portion 41 with a gap therebetween, i.e., the restricting portion 41 is loosely inserted between the pair of bosses 56.

The extension portion 52 extends upward from the outer peripheral surface of the flange portion 53, and has a generally plate shaped. The extension portion 52 is provided with a power-feed receiving portion 54 positioned at an upper portion of the extension portion 52 and protruding rightward from a right side surface of the extension portion 52. The power-feed receiving portion 54 is generally semispherical shaped. A compression spring 62 as an urging member is disposed over the protruding portion 29A of the developing roller shaft 29 and is interposed between the collar member 33 and the bearing member 32 for urging the collar member 33 rightward. Apparently, the compression spring 62 has an inner diameter greater than the outer diameter of the developing roller shaft 29.

For assembling the bearing member 32 and the collar member 33 to the cartridge frame 31, firstly, the bearing member 32 is assembled to the cartridge frame 31. To this effect, the bearing member 32 is positioned at the right side of the cartridge frame 31. Then, the developing roller shaft 29 is inserted into the insertion hole 40, the supply roller shaft 28 is inserted into the insertion hole 42, and a posture of the bearing member 32 is adjusted so as to fit the bosses 36 with the positioning holes 43. Upon fitting engagement between the bosses 36 and the positioning holes 43, the thread 61 is inserted through the thread insertion hole 44 and is threadingly engaged with the thread hole 37 of the cartridge frame 31. Thus, the bearing member 32 can be fixed to the cartridge frame 31.

In this case, a rightmost end of the developing roller shaft 29 is positioned rightward of a rightmost end of the bearing member 32. Then, as shown in FIGS. 3 and 4, the collar member 33 is assembled to the right end portion of the developing roller shaft 29. To this effect, firstly, the compression spring 62 is disposed over the right end portion of the developing roller shaft 29. Then, the collar member 33 is positioned at the right side of the developing roller shaft 29, and the collar member 33 is capped on the right end portion of the developing roller shaft 29 from a position rightward of the compression spring 62 so as to provide engagement between the engagement pawls 57 and the engagement groove 27. In this case, the collar member 33 is urged rightward by the urging force of the compression spring 62, so that the hook portions of the engagement pawls 57 are brought into engagement with a right side wall of the engagement groove 27. Thus, further rightward movement of the collar member 33 is restricted as shown in FIG. 4(*b*).

In this case, the collar member 33 is capped on the developing roller shaft 29 such that the rightmost end of the developing roller shaft 29 is positioned leftward of the rightmost end of the collar portion 51, i.e., the right end portion of the developing roller shaft 29 is completely surrounded by the collar portion 51 as shown in FIG. 4(*b*). Further, an inner peripheral surface of the collar portion 51 is in contact with the outer peripheral surface of the developing roller shaft 29. That is, the collar member 33 is in electrical contact with the developing roller shaft 29. At the same time, the fitting portion 55 of the collar member 33 is fitted with the restricting portion 41 as shown in FIG. 2. Upon fitting the fitting portion 55 with the restricting portion 41, rotation of the collar member 33 about an axis of the developing roller shaft 29 due to the rotation of the developing roller shaft 29 can be obviated. Thus, assembly of the collar member 33 to the developing roller shaft 29 can be completed.

3. Electrical Power Supply to the Developing Cartridge

For the electrical power supply to the developing roller 15, the developing cartridge 14 must be installed on the main casing 2. To this effect, the front cover 5 is opened to draw the process unit 9 frontward out of the main casing 2. In this state, the developing cartridge 14 can be installed on the process unit 9.

For installing the developing cartridge 14 to the process unit 9, the developing cartridge 14 is positioned above the process unit 9 such that the collar portion 51 can be positioned above the guide groove 82 of the side plate 81. Then, the developing cartridge 14 is moved downward, whereupon movement of the collar portion 51 is guided by the guide groove 82, thereby positioning the developing cartridge 14 at a fixed position in the process unit 9. Although not shown in the drawings, a left side plate 81 is also formed with a guide groove 82 for guiding left end portion of the developing roller shaft 29. Therefore, leftward displacement of the developing cartridge 14 can be prevented.

As shown in FIG. 5, upon completion of assembly of the developing cartridge 14 to the process unit 9, the power-feed receiving portion 54 of the collar member 33 is brought into contact with the left end portion of the relay electrode 83. In this case, the collar member 33 is urged leftward by the reaction force from the relay electrode 83 through the power-feed receiving portion 54 against the urging force of the compression spring 62.

More specifically, by the leftward movement of the collar member 33, the rightmost end of the developing roller shaft 29 is positioned slightly rightward of the rightmost end of the collar portion 51, and the collar portion 51 is slidingly moved leftward such that the flange portion 53 of the collar portion 51 confronts the laterally inner surface of the side plate 81 with a small gap therebetween. Thus, the power-feed receiving portion 54 is in contact with the relay electrode 83 with a resiliency of the compression spring 62, and thus, stabilized electrical contact between power-feed receiving portion 54 and the relay electrode 83 can be provided.

Upon completion of assembly of the process unit 9 into the main casing 2 as a result of the frontward sliding movement of the process unit 9, the right end portion of the relay electrode 83 is brought into contact with the electrode 84 (FIG. 5) provided in the main casing 2

Upon supply of electrical power from the power source 85 to the relay electrode 83 through the electrode 84 of the main casing side 2, the electrical power is supplied to the developing roller shaft 29 through the power-feed receiving portion 54 of the collar member 33.

Incidentally, the developing cartridge 14 can be removed from the main casing 2 by opening the front cover 5, pulling the process unit 9 frontward from the main casing 2, and pulling the developing cartridge 14 upward from the process unit 9.

As described above, the collar member 33 includes the electrically conductive collar portion 51 electrically connected to the developing roller shaft 29, and the electrically conductive power-feed receiving portion 54 integrally with the collar portion 51 and in electrical contact with the relay electrode 83, stabilized electrical power supply to the developing roller 15 with a simple construction can be realized only by the collar member 33.

Further, since the compression spring 62 is interposed between the bearing member 32 and the collar member 33 as shown in FIG. 4(*a*) so as to normally urge the collar member 33 rightward, the collar member 33 can be movable relative to the bearing member 32 while being resiliently urged away from the bearing member 32. Accordingly, the power-feed receiving portion 54 of the collar member 33 is resiliently urged toward the relay electrode 83, thereby stabilizing electrical contact between the power-feed receiving portion 54 and the relay electrode 83.

Further, as shown in FIG. 2, the power-feed receiving portion 54 is provided at the extension portion 52 extending upward from the collar portion 51. That is, the power-feed receiving portion 54 is positioned at an upstream side of the developing cartridge 14 in a direction of installation of the developing cartridge 14 to the process unit 9. Therefore, the developing cartridge 14 can be smoothly installed on the process unit 9 in comparison with a case where the power-feed receiving portion 54 is positioned at downstream side of the developing cartridge 14.

Further, rotation of the collar member 33 due to the rotation of the developing roller shaft 29 can be prevented by the loose-fitting engagement between the fitting portion 55 and the restricting portion 41 as shown in FIG. 2. Therefore, stabilized electrical connection between the power-feed receiving portion 54 and the relay electrode 83 can be provided regardless of the rotation of the developing roller 15.

While the invention has been described in detail and with reference to the specific embodiment thereof, it would be apparent to those skilled in the art that various changes and modifications may be made therein without departing from the scope of the invention.

Although, the developing cartridge 14 accommodates toner therein in the above-described embodiment, the present invention is not limited to this configuration. A toner cartridge for accommodating the toner may be detachably mounted on the developing cartridge.

In the above-described embodiment, the fitting portion 55 includes the pair of bosses 56, and the bearing member 32 includes the restricting portion 41 loosely engageable with the pair of bosses 56. However, the present invention is not limited to this configuration. The fitting portion 55 may be formed with a notch engageable with the restricting portion 41, provided that they are loosely engaged with each other.

What is claimed is:

1. A developing cartridge comprising:

a cartridge frame;

a developer carrier having a surface configured to carry a developer agent and a rotation shaft made from an electrically conductive material, the rotation shaft defining an axial direction and having an axial end portion;

a bearing member provided at the cartridge frame and rotatably supporting the rotation shaft; and a collar member provided at a position outside of the bearing member in the axial direction and movable relative to the bearing member in the axial direction, the collar member being rotatable relative to the rotational shaft of the developer carrier, the collar member comprising:

a cap portion covering the axial end portion of the rotation shaft and electrically contacted with the rotation shaft, the cap portion being made from an electrically conductive material; and a power-feed receiving portion made from an electrically conductive material and electrically contactable with an external electrode, the power-feed receiving portion being provided integrally with the cap portion.

2. The developing cartridge as claimed in claim 1, further comprising an urging member disposed between the bearing member and the collar member for normally urging the collar member outward in the axial direction.

3. The developing cartridge as claimed in claim 1 wherein the collar member further includes an extension portion extending from the cap portion and positioned at an upstream side of the cartridge frame in a direction of installation of the developing cartridge into a main casing.

4. The developing cartridge as claimed in claim 3, wherein the power-feed receiving portion is provided at the extension portion.

5. The developing cartridge as claimed in claim 1, wherein the cartridge frame includes a restricting portion; and wherein the collar member includes a fitting portion engageable with the restricting portion for preventing the collar member from being rotated upon rotation of the rotation shaft.

6. The developing cartridge as claimed in claim 5, wherein the restricting portion is loosely fitted with the fitting portion.

7. The developing cartridge as claimed in claim 5, wherein the restricting portion protrudes in the axial direction, and the fitting portion is configured of a pair of bosses extending radially outward of the rotation shaft, wherein the restricting portion is interposed between the pair of bosses such that the restricting portion is loosely fitted with the fitting portion.

8. A developing cartridge comprising:

a cartridge frame;

a developer carrier having a surface configured to carry a developer agent and a rotation shaft made from an electrically conductive material, the rotation shaft defining an axial direction and having an axial end portion;

a bearing member provided at the cartridge frame and rotatably supporting the rotation shaft; and a collar member provided at a position outside of the bearing member in the axial direction and movable relative to the bearing member in the axial direction, the collar member comprising:

a cap portion covering the axial end portion of the rotation shaft and electrically contacted with the rotation shaft, the cap portion being made from an electrically conductive material;

a power-feed receiving portion made from an electrically conductive material and electrically contactable with an external electrode, the power-feed receiving portion being provided integrally with the cap portion; and an extension portion extending from the cap portion and positioned at an upstream side of the cartridge frame in a direction of installation of the developing cartridge a the main casing.

9. The developing cartridge as claimed in claim 8, further comprising an urging member disposed between the bearing member and the collar member for normally urging the collar member outward in the axial direction.

10. The developing cartridge as claimed in claim 8, wherein the power-feed receiving portion is provided at the extension portion.

11. The developing cartridge as claimed in claim 8, wherein the cartridge frame includes a restricting portion; and wherein the collar member includes a fitting portion engageable with the restricting portion for preventing the collar member from being rotated upon rotation of the rotation shaft.

12. The developing cartridge as claimed in claim 11, wherein the restricting portion is loosely fitted with the fitting portion.

13. The developing cartridge as claimed in claim 11, wherein the restricting portion protrudes in the axial direction, and the fitting portion is configured of a pair of bosses extending radially outward of the rotation shaft, wherein the restricting portion is interposed between the pair of bosses such that the restricting portion is loosely fitted with the fitting portion.

14. A developing cartridge comprising:

a cartridge frame including a restricting portion;

a developer carrier having a surface configured to carry a developer agent and a rotation shaft made from an electrically conductive material, the rotation shaft defining an axial direction and having an axial end portion;

a bearing member provided at the cartridge frame and rotatably supporting the rotation shaft; and a collar member provided at a position outside of the bearing member in the axial direction and movable relative to the bearing member in the axial direction, the collar member comprising:

a cap portion covering the axial end portion of the rotation shaft and electrically contacted with the rotation shaft, the cap portion being made from an electrically conductive material;

a power-feed receiving portion made from an electrically conductive material and electrically contactable with an external electrode, the power-feed receiving portion being provided integrally with the cap portion; and a fitting portion engageable with the restricting portion for preventing the collar member from being rotated upon rotation of the rotation shaft.

15. The developing cartridge as claimed in claim 14, further comprising an urging member disposed between the bearing member and the collar member for normally urging the collar member outward in the axial direction.

16. The developing cartridge as claimed in claim 14 wherein the collar member further includes an extension portion extending from the cap portion and positioned at an upstream side of the cartridge frame in a direction of installation of the developing cartridge into a main casing.

17. The developing cartridge as claimed in claim 16, wherein the power-feed receiving portion is provided at the extension portion.

18. The developing cartridge as claimed in claim 14, wherein the restricting portion is loosely fitted with the fitting portion.

19. The developing cartridge as claimed in claim 14, wherein the restricting portion protrudes in the axial direction, and the fitting portion is configured of a pair of bosses extending radially outward of the rotation shaft, wherein the restricting portion is interposed between the pair of bosses such that the restricting portion is loosely fitted with the fitting portion.

* * * * *